US005573366A

United States Patent [19]

Meijer

[11] Patent Number: 5,573,366

[45] Date of Patent: Nov. 12, 1996

[54] HYDRAULIC DEVICE WITH SYNCHRONOUSLY OPERATING JACKS

[76] Inventor: Sjoerd Meijer, No. 894, Oude Bildtdijk, 9079 NG St. Jacobiparochie, Netherlands

[21] Appl. No.: 284,565

[22] PCT Filed: Mar. 29, 1993

[86] PCT No.: PCT/NL93/00077

§ 371 Date: Aug. 9, 1994

§ 102(e) Date: Aug. 9, 1994

[87] PCT Pub. No.: WO93/20354

PCT Pub. Date: Oct. 14, 1993

[30] Foreign Application Priority Data

Mar. 30, 1992 [NL] Netherlands ..... 9200589

[51] Int. Cl.[6] ..... F15B 11/22

[52] U.S. Cl. ..... 414/664; 60/591; 100/269.06; 414/785

[58] Field of Search ..... 414/664, 668, 414/785; 60/591; 91/405, 406, 409; 100/269.06, 258 A

[56] References Cited

U.S. PATENT DOCUMENTS

| | | | |
|---|---|---|---|
| 855,266 | 5/1907 | Thorschmidt | 91/409 X |
| 2,536,068 | 1/1951 | Lehmann | 414/664 |
| 3,393,635 | 7/1968 | Richardson | 100/269.06 X |
| 3,590,581 | 7/1971 | Biarchi | 100/269.06 X |
| 3,998,312 | 12/1976 | Ragigade | 91/406 X |
| 4,157,066 | 6/1979 | Pretty | 100/258 A |
| 4,641,894 | 2/1987 | Belart | 60/591 X |
| 4,908,522 | 3/1990 | Crumb et al. | 60/591 X |
| 5,011,363 | 4/1991 | Conley, III et al. | 414/785 X |

FOREIGN PATENT DOCUMENTS

| | | | |
|---|---|---|---|
| 2018365 | 10/1979 | United Kingdom | 60/591 |

*Primary Examiner*—David A. Bucci
*Attorney, Agent, or Firm*—Mark Zovko

[57] ABSTRACT

A hydraulic device comprising at least two cylinder-piston assemblies. Each of the assemblies are of the double-action type with a front and rear chamber on either side of a piston. The chambers are connected in series in a hydraulic control circuit such that the front chamber of a first assembly has a direct connection to a rear chamber of a second assembly. At least one of the cylinder-piston assemblies is provided with a valve assembly which opens a bypass thereby bypassing the piston of the assembly when the piston is situated close to the direct connection at the end of its stroke and the effective piston surfaces are the same in the chambers mutually connected by the direct connection.

10 Claims, 5 Drawing Sheets

22
8
$d_2$
$D_2$

10
$D_1$ 22
18
32
IIA
IIA
8
16
17
15
13
28
29
23
14
31
19
21
10
IIB
IIB
20
27
26
30

HYDRAULIC DEVICE WITH SYNCHRONOUSLY OPERATING JACKS

BACKGROUND OF THE INVENTION

1. Field of the Invention

This invention relates in general to a hydraulic device incorporating a cylinder-piston assembly, and more particularly a double acting hydraulic device having at least two cylinder-piston assemblies which operate synchronously.

2. Description of the Prior Art

A device having a double acting cylinder-piston assembly is known from FR-A-2 380 218.

Because the effective piston surfaces are the same in the chambers mutually connected by the direct connection, the quantity of oil displaced from the one chamber will provide in the other chamber an equal displacement of the relevant piston. The valve means bring about a synchronous adjustment of the pistons at the end of each stroke. Any leakage of oil from the two chambers mutually connected by the direct connection would normally result in a nonsynchronous position of the pistons, although the movements continue to proceed at exactly the same speed. Use of the said valve means results in the oil that may be lost through leakage being supplemented via the bypass at the end of each stroke.

Due to the non-return valves oil under pressure can only be fed in one direction, in the shown embodiment in the direction in which the piston rod extend. The ingoing stroke occurs due to external force.

SUMMARY OF THE INVENTION

The invention has for its object to provide a device of the kind set forth above in which the cylinder-piston assemblies can be fed with oil under pressure in two directions, such that the piston rods can be extended as well as retracted by oil under pressure.

In a hydraulic device according to the invention this object is achieved with the characterizing measures described herein In a specific embodiment of the invention easily available identical cylinder-piston assemblies can be used. The effective piston surfaces are the same in all chambers of these assemblies so that in a random series connection the desired synchronous operation is automatically obtained.

In applications wherein it is not possible to work with cylinder-piston assemblies with a continuous piston rod a preferred embodiment of the invention described subsequently can be applied. Also in this case the same effective piston surface of the mutually communicating chambers is obtained, which ensures the desired synchronous operation.

With the measure as characterized in that a further valve is formed by the piston in association with openings of the bypass in the cylinder wall a simple, and reliable construction is achieved.

A further favorable development is characterized in that the relevant end position both valve means are opened so that hydraulic oil fed from a pressure conduit can flow through the chambers connected in series of the cylinder-piston assemblies. Venting of the cylinders hereby takes place automatically and after a possible disassembly the system can in this manner be filled with oil very rapidly, wherein any air that may be present is simply displaced.

With a further embodiment is achieved that the valve means are simple to maintain. By removing the pistons from the cylinders the valve means become directly accessible.

According to a further development of the invention the device can comprise a number of pairs of cylinder-piston assemblies each connected in series, wherein the hydraulic control circuit comprises valve means for connecting the pairs of assemblies at choice in parallel or in series. when the pairs are connected in series an absolutely precise synchronous operation of each of the cylinder-piston assemblies is achieved, wherein each of the assemblies produces force corresponding to its load, while in the case of the parallel connection of the pairs a greater force can be generated at a lower speed.

BRIEF DESCRIPTION OF THE DRAWINGS

FIG. 2B shows a cross section according to line IIB—IIB of FIG. 2.

DESCRIPTION OF THE PREFERRED EMBODIMENT

Figure 1:
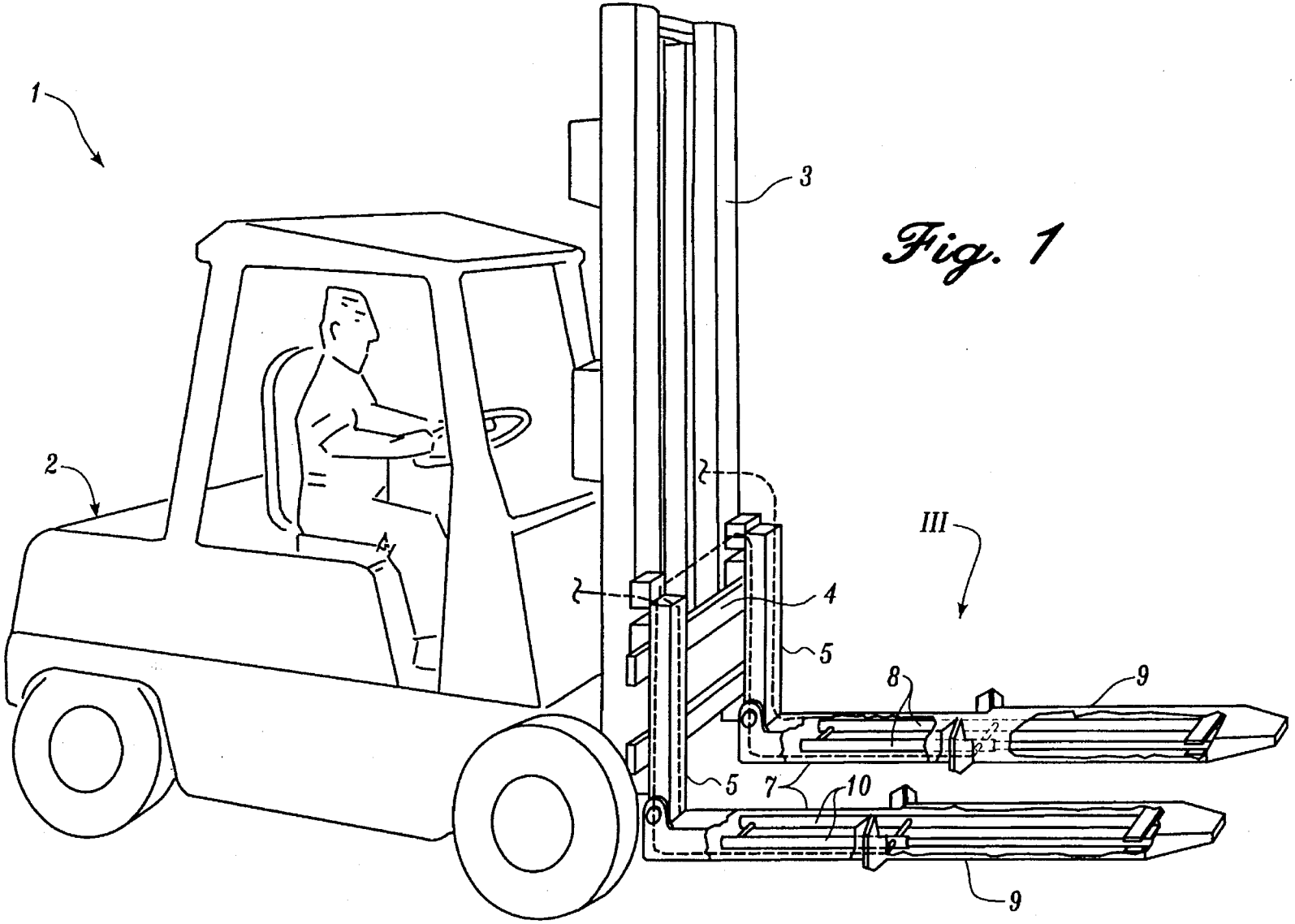
FIG. 1 shows schematically a fork-lift truck according to the invention.

The fork-lift truck 1 shown in FIG.1 comprises a vehicle 2 bearing on its front end a mast 3. Mounted on this mast 3 is a fork carrier 4. This latter is vertically displaceable in per se known manner for instance by hydraulic cylinders.

Arranged on the fork carrier 4 are two prongs 5. These prongs 5 each comprise a basic body with a forward protruding portion 7. The forward extending portions can be placed in a pallet or under a container or the like, whereafter this pallet or container can be lifted along the mast 3 by moving the fork carrier 4 upward.

The prongs of the fork-lift truck 1 as in FIG. 1 are of an extending type. That is, they are provided with a sleeve 9 which is slidable over the protruding portion 7 and which can be extended to the front or retracted by means of hydraulic cylinders 8 and 10 respectively. The load, such as the above mentioned pallet or container, is herein supported by the upper surface of the sleeves 9 so that this load can be moved forward or backward relative to the basic body of prong 5. It is hereby possible to pick up or to place a load. at a greater distance than is possible when no extending prongs are employed. Using the extending prongs it is for instance possible to place two pallets one behind the other on the loading floor of a goods vehicle.

To obtain good synchronous operation of the sleeves the hydraulic cylinder-piston assemblies 8, 10 in the mutually adjacent prongs are embodied according to the invention in a particular manner and connected in a hydraulic circuit. The principle is shown in FIG. 2.

Figures 2, 2A, 2B:
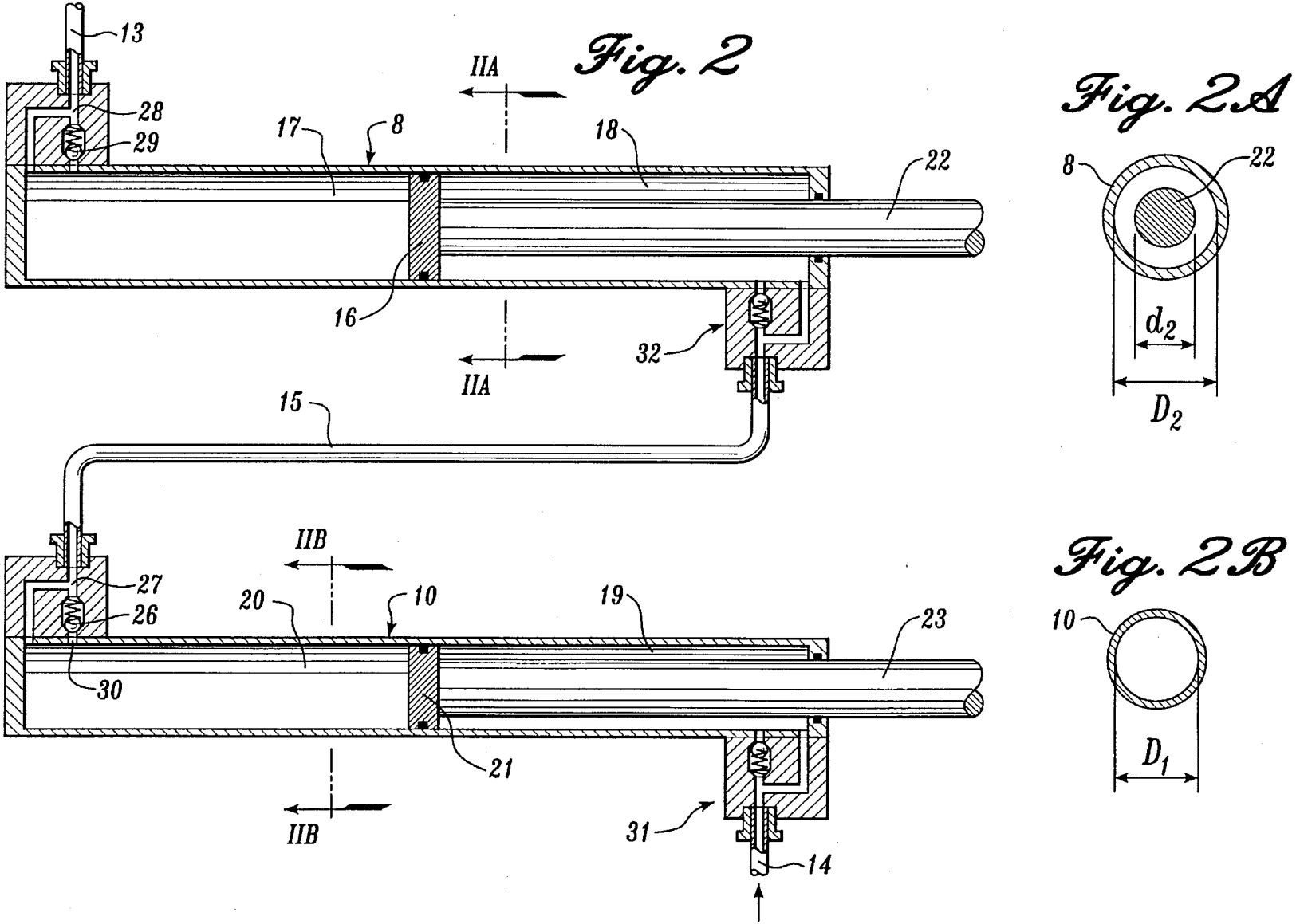
FIG. 2B shows a cross section according to line IIA—IIA of FIG. 2.
FIG. 2 shows a diagram elucidating the invention.

The two cylinder-piston assemblies 8, 10 as shown in FIG. 2 are each situated in one prong 5. Each cylinder-piston assembly 8, 10 is of the double-action type with a chamber on either side of the piston. The cylinder-piston assembly 8 for instance has a chamber 17 and 18 on either side of piston 16. Extending through the chamber 18 is the piston rod 22 to which the sleeve is connected. In similar manner the cylinder-piston assembly 10 has two chambers 20 and 19 on either side of piston 21, wherein the piston rod 23 extends through chamber 19.

The different chambers of the cylinder-piston assemblies 8, 10 are connected in series in the hydraulic control circuit. That is, the hydraulic feed and drain conduit 14 is connected to chamber 19 of cylinder-piston assembly 10, the chamber 20 of which is connected via a direct connection 15 to chamber 18 of the second cylinder-piston assembly 8, while the chamber 17 of this assembly 8 is in turn connected to the feed and drain conduit 13 of the hydraulic circuit. The direct connection 15 is thus connected at one end to a chamber 20 through which a piston rod does not extend and is connected at the other end to a chamber 18 through which a piston rod does extend. According to the invention the diameter D1 of the cylinder whereof the chamber through which a piston rod does not extend is connected to the direct connection 15 is now smaller than the diameter D2 of the cylinder whereof the chamber through which a piston rod does extend is connected to the connection 15. The cylinder diameter D1 of the first assembly 10 is equal to the root of the difference of the squares of the cylinder diameter D2 and the piston rod diameter d2 of the second assembly 8. The effective diameter of the chamber 20 of assembly 10 is hereby equal to the effective diameter of the chamber 18 of assembly 8. The result of this step is that the oil displaced by one of the pistons 16, 21 via the direct connection 15 brings about an identical displacement of the other piston.

At the return stroke hydraulic oil under pressure is fed via the conduit 14 into the chamber 19 of the assembly 10. The piston 21 is hereby driven to the left as seen in FIG. 2 wherein this piston 21 displaces hydraulic oil out of the chamber 20. This oil flows via the direct connection 15 to chamber 18 of assembly 8 whereby the piston 16 is displaced. Since in accordance with the above explained step the effective diameter of chambers 20 and 18 is the same, the piston 21 moves precisely at the same speed as piston 21. The oil displaced from chamber 17 by piston 16 is drained via the hydraulic conduit 13 functioning at that moment as drain conduit. At an outward stroke hydraulic oil under pressure is fed via the conduit 13 and the piston 21 is driven in similar manner by means of oil which is pressed by piston 16 out of chamber 18 via the connection 15 to chamber 20 of assembly 10. During both outward and return stroke the piston rods thus move at exactly the same speed.

The preferred embodiment shown schematically in FIG. 2 is further provided with valve means which are formed by a non-return valve 26 and which become operational when the piston 21 is situated close to the direct connection 15 at the end of its stroke, that is, at the left-hand end of its stroke as seen in FIG. 2. When the piston 21 has passed the inlet 30 to the non-return valve 26 this non-return valve 26, under influence of the hydraulic oil under pressure, opens a bypass 27 which bypasses the piston 21. Hydraulic oil under pressure supplied via the conduit 14 can hereby flow via valve 26 into the direct connection 15 and to the chamber 18. Should oil have leaked for any reason out of the normally closed part of the hydraulic circuit formed by chamber 18, connection 15 and chamber 20, the piston 21 will then reach the end of its stroke earlier than the piston 16. In this situation the piston 16, 21 would still move at the same speed, but the piston rod 22 would always be extended a little further than piston rod 23. By means of the valve means 26 a possibly shifted position as a result of leaked oil is now compensated immediately. If for instance the piston 21 has reached its end position and the piston 16 has not yet reached its end position, hydraulic oil under pressure supplied via the conduit 14 flows in the described manner via valve 26 and the direct connection 15 into chamber 18, while the piston 21 remains stationary. The piston 16 is therefore also driven into its end position. At the following outward stroke the pistons 16 and 21 will then once again have precisely the same position. Due to the action of the non-return valve 26 the bypass 27 is blocked when the piston 21 is driven to the right, so that the oil under pressure supplied via the direct connection 15 is fed behind the piston 21.

As shown in FIG. 2, the cylinder-piston assembly 8 is likewise provided with valve means which are formed by a non-return valve 29 and which open a bypass 28 also bypassing the piston 16 when piston 16 is situated in the same end position as that in which the valve means 26 for the piston 21 are operaitive.

The non-return valve 29 thus opens when the piston 16 lies in its left-hand end position. A free connection is hereby formed in this end position between the feed conduit 14 and the conduit 13 functioning in that case as drain conduit, via the chamber 19, non-return valve 26, bypass 27, direct connection 15, chamber 18, non-return valve 29 and bypass 28. When the operative has thus moved the cylinders into their fully retracted position an oil flow can still run for a time from the feed conduit 14 to the drain conduit 13, which flow carries away any possible gas or air bubbles in the system. Automatic venting and synchronous adjustment of the cylinders is thus obtained each time the device is used.

The preferred embodiment shown schematically in FIG. 2 comprises further valve means 31 and 32. The valve means 32 operate in the same manner as valve means 26 and the valve means 31 in the same way as valve means 29 during the outward stroke.

In practice it will be possible to suffice with valve means close to one of the end positions of the pistons.

Figure 3:
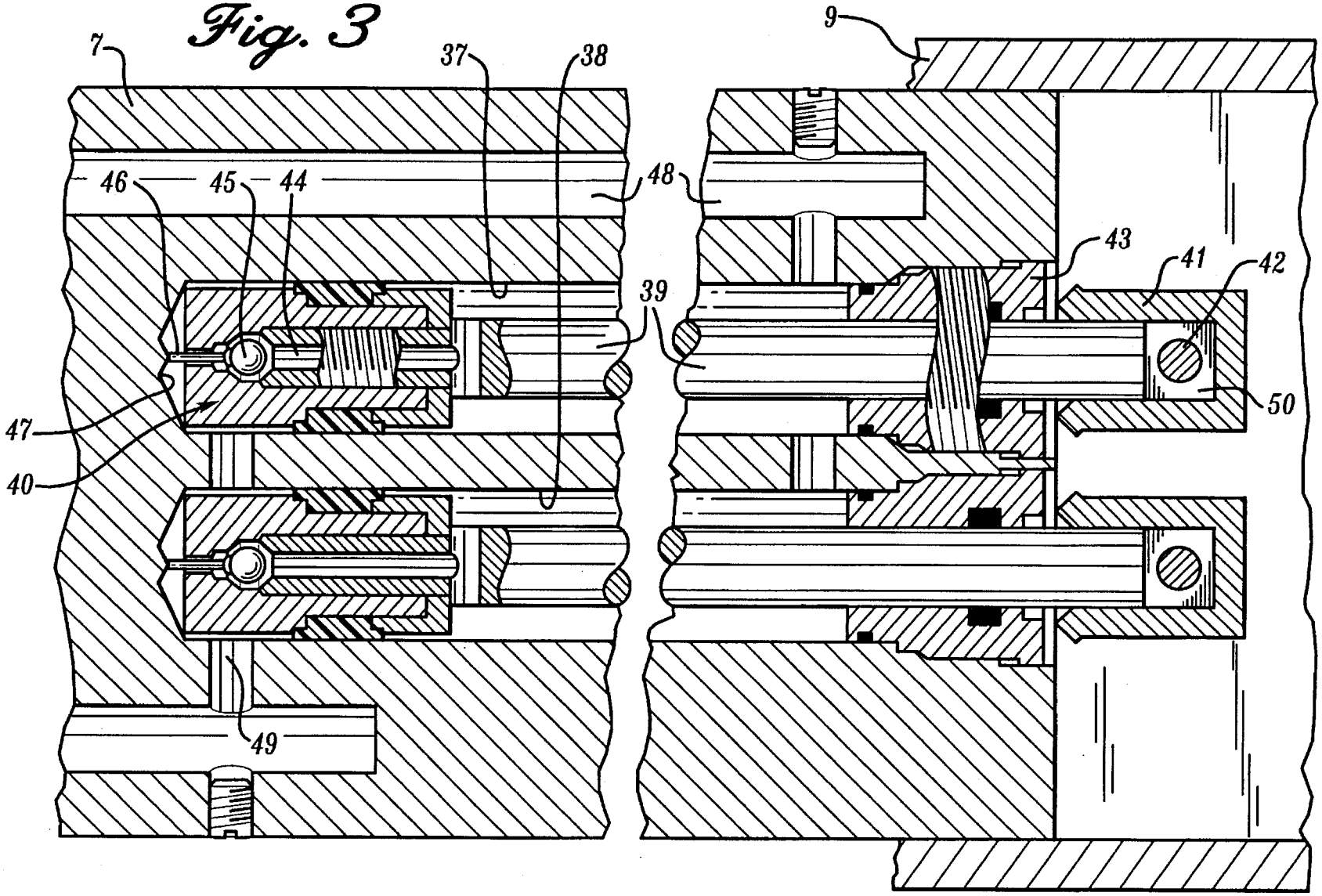
FIG. 3 shows the section of a prong with an integrated double cylinder-piston assembly according to the invention.

Shown in FIG. 3 is an axial cross-sectional top view along arrow III of a preferred embodiment of the device of FIG. 1. Herein two hydraulic cylinders connected in parallel are arranged in each prong. These two hydraulic cylinder-pistons connected in parallel are functionally identical to one of the assemblies 8 or 10 in FIG. 2.

As shown in FIG. 3, the two hydraulic cylinder-pistons are formed in the protruding portion 7 of the basic part of the prong by boring out cylinders 37 and 38 therein. The cylinders 37 and 38 are identical so that a description of the cylinder 37 will suffice.

A piston 40 mounted on a piston rod 39 is slidable in the cylinder 37. At the leading end, on the right in FIG. 3, the cylinder bore is closed with a screwed-in bushing 43 which seals in relation to both the cylinder bore and the piston rod 39. Arranged on the end of the piston rod protruding outside the bushing 43 is a bracket 41 which defines an eye 50 through which is placed a removable pin 42 which engages on the sleeve 9.

Extending through piston 40 and the portion of the piston rod 39 received therein is a bypass 44 which bypasses the piston 40. A double-action non-return valve 45 is arranged in this bypass 44. Received in the front portion of the bypass 44 is a freely slidable pin 46 which can come into contact with the bottom 47 of the cylinder bore in the end position of the piston 40 shown in FIG. 3. In this situation the pin 46 presses the ball of the non-return valve 45 from its seat so that the bypass 44 is opened.

The second prong has corresponding cylinder-piston assemblies. The diameter of the cylinder bores thereof are different however. After the above it will be apparent that if the direct connection takes place via channel 49 the diameter of the cylinders in the other prong must be larger, and when the connection takes place via channel 48 the diameter of these bores will be smaller.

Assuming that the direct connection to the double cylinder-piston assembly in the other prong takes place via. channel 49, the operation is as follows. From the retracted position shown in FIG. 3 the prongs, or rather the sleeves 9 thereof, are pushed out by feeding oil under pressure to the channel of the other prong corresponding to the channel 49. The oil displaced by the pistons of this prong is then supplied via channel 49. The balls of the non-return valves 45 hereby move to the right and each close the bypass channel 44. The oil fed via channel 49 therefore urges the pistons 40 to slide to the right. At the change-over to the return stroke oil under pressure is fed via channel 48. Because the pressure now becomes greater on the right-hand side of piston 40 the ball of non-return valve 45 is displaced to the left against its other seat. The pin 46 can herein move freely to the left so that it does not obstruct closing of valve 45. When further oil under pressure is supplied via channel 48 the pistons 40 move to the left, wherein the oil displaced thereby is fed via channel 49 to the cylinder-piston assembly of the other prong in order to effect the corresponding movement. At the end of the stroke the pin 46 comes into contact with the bottom 47 and the ball of valve 45 is raised from its seat. Oil Under pressure supplied via channel 48 can hereby flow via the bypass 44 to the channel 49 in order, if necessary, to drive the pistons in the other prong further into their end position, whereafter by opening the non-return valves in these pistons a continuous channel is formed which effects venting of the system in the above described manner.

The preferred embodiment shown in FIG. 3 has the advantage of a simple fitting and simple maintenance. By removing the piston rod with piston the valve means are also immediately accessible. The basic body 7 of the prong does not contain any components requiring frequent maintenance. After re-assembly the air can be expelled from the system very rapidly by moving the pistons in the manner described into their end position in which the valve means 45 are operational and carry an oil flow through the system for a time.

Figure 4:
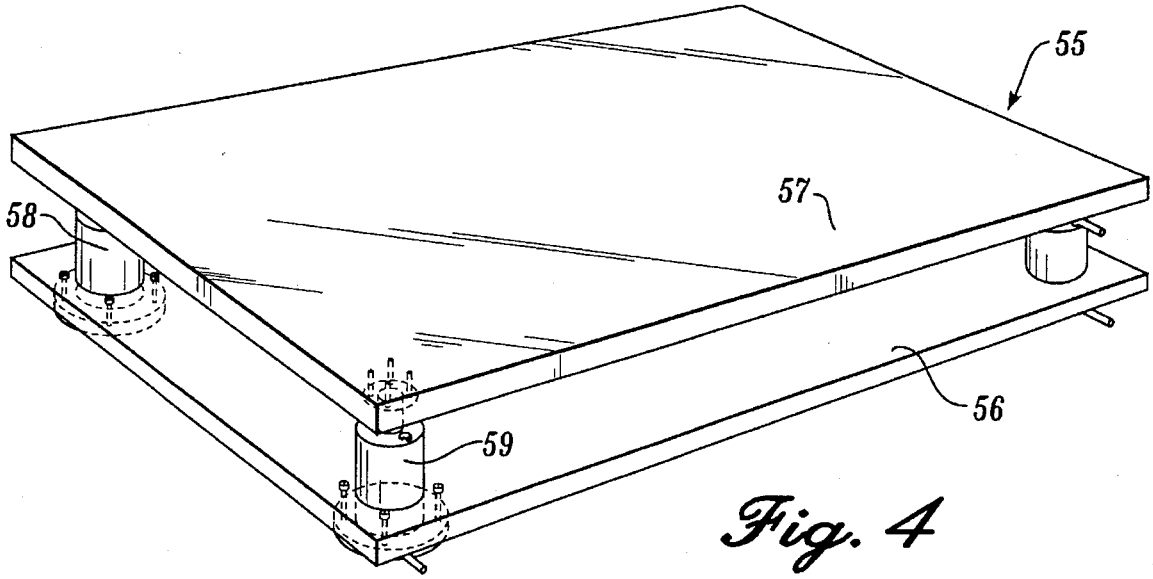
FIG. 4 is a perspective view of a punching table according to the invention.

Shown in FIG. 4 is a punching table 55 which forms a device according to the invention. This punching table comprises a lower plate 56 and an upper plate 57, with cylinder-piston assemblies arranged on the four corners, two being designated respectively 58 and 59.

Figure 5:
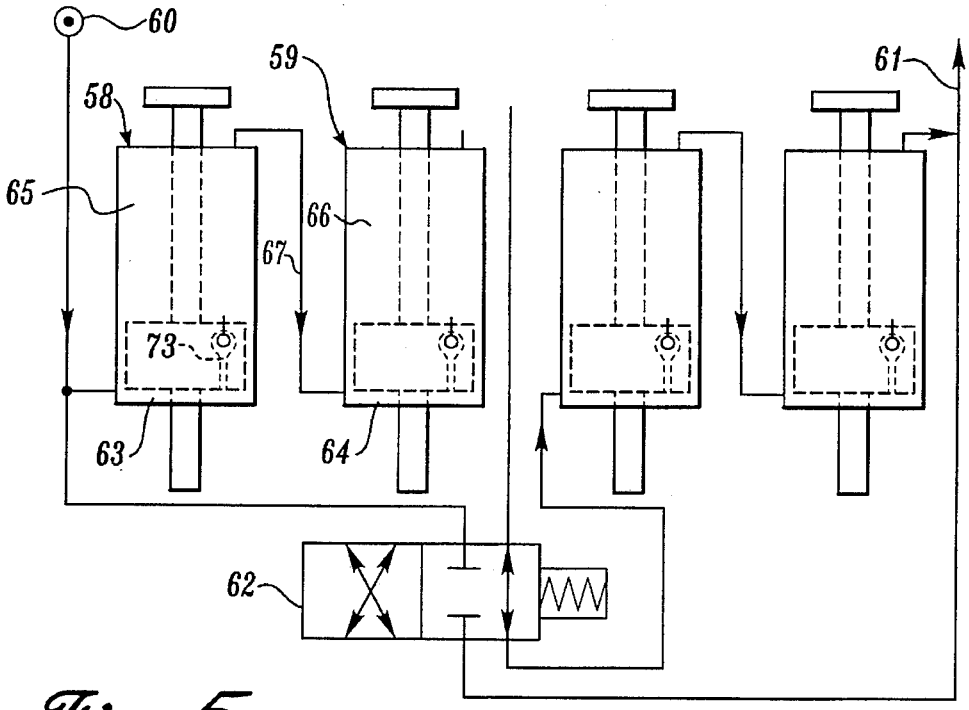
FIG. 5 shows a diagram elucidating the operation of the punching table.

The circuit diagram of the four cylinder-piston assemblies is shown in figure 5. As shown, the assembly 58 has a front chamber 63 and a rear chamber 65 and the assembly 59 has a front chamber 64 and a rear chamber 66. The front chamber 64 of piston 59 is connected through a direct connection 67 to the rear chamber 65 of assembly 58.

The terminals 60 and 61 can be connected alternately to a medium pressure source and to the discharge, depending on the desired direction of movement of the piston rods. For the explanation it is assumed in FIG. 5 that the terminal 60 is connected to the pressure source and the terminal 61 to the discharge. In the shown switch position of the valve 62 the two pairs of cylinder-piston assemblies are connected in series. The oil under pressure fed via terminal 60 flows to the front chamber 63 of the assembly 58. The piston rod is hereby moved upward as seen in FIG. 5 and hydraulic oil is displaced from the rear chamber 65. This displaced oil is supplied via the direct connection 67 to the front chamber 64 of assembly 59, whereby the relevant piston rod moves synchronously. The oil displaced from the rear chamber 66 of assembly 59 flows via valve 62 to the front chamber of the following assembly and so on. All four piston rods thus move synchronously.

The valve 62 can also be placed in a position shifted to the right as seen in FIG. 5, wherein the left and right hand pair of cylinder-piston-assemblies are connected in parallel. The pairs are fed simultaneously in this manner so that the piston rods move at half the speed but can produce a twice as great force.

Figure 6:
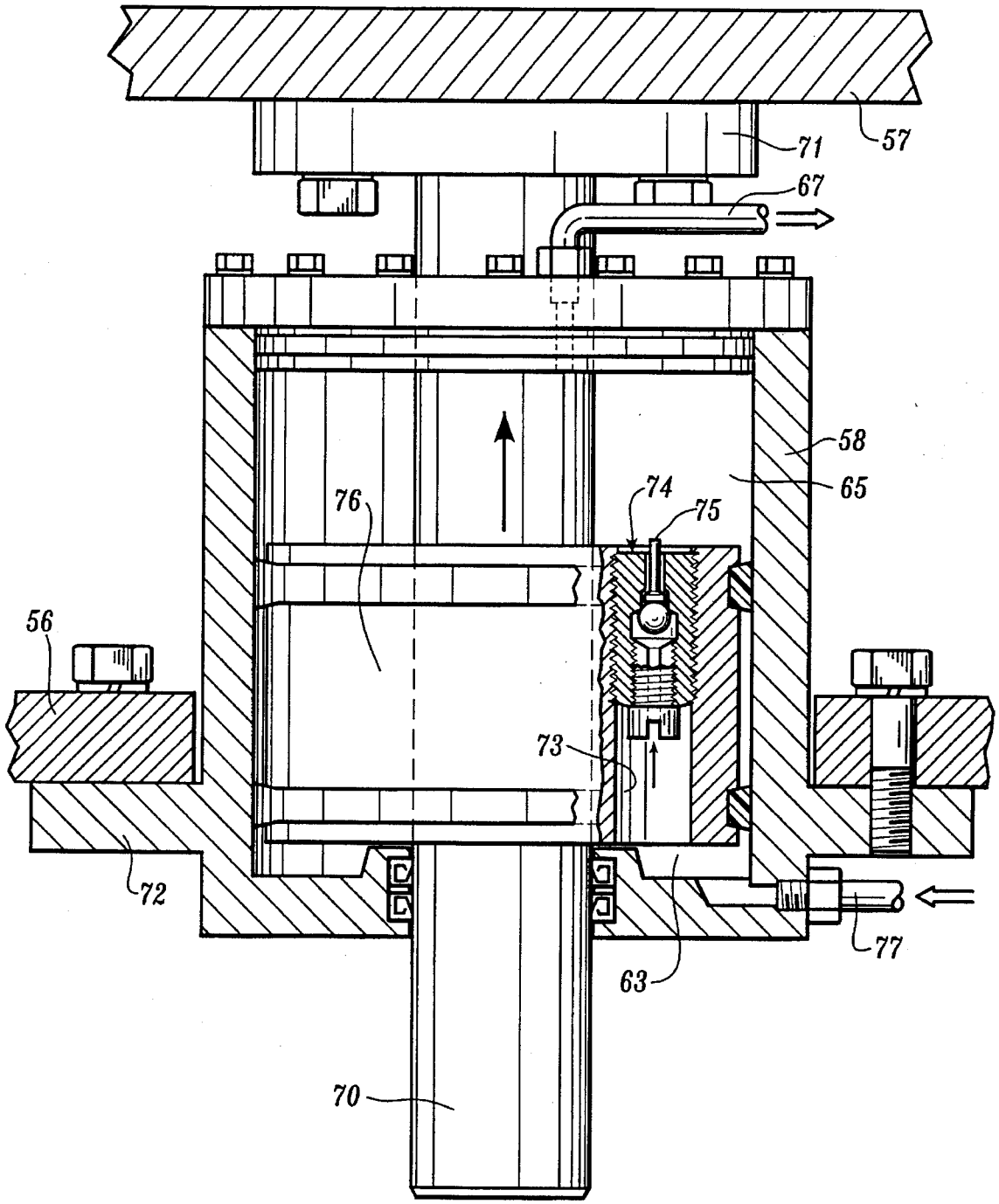
FIG. 6 shows a section of one of the hydraulic cylinders of the device of FIG.4.

All four of the cylinder-piston assemblies of the device 55 are identical. One of these assemblies 58 is shown in detail in FIG. 6. As can be seen., this assembly is provided with a continuous piston rod 70 so that the effective surface of piston 76 in the front chamber 63 is the same as that in the rear chamber 65. This means that exactly the same amount of hydraulic oil is displaced from the rear chamber 65 as is fed into the front chamber 63 and vice-versa. Piston rod 70 is provided at its upper end as seen in FIG. 6 with a flange 71 with which it is connected with a bolt connection to the upper plate 57 of the punching table. Cylinder 58 is likewise provided with a flange 72 with which it is connected to the lower plate 56.

In the embodiment shown the bypass channel 73 is arranged in piston 76. The valve means 74 are identical to those used in the fork-lift truck described in the foregoing. A double-action non-return valve is thus also used here with a lifting member 75. As soon as piston 76 has moved into its highest position the protruding end of the lifting or actuating member 75 comes into contact with the wall of cylinder 58 and the ball is thereby lifted from its seat. The hydraulic oil under pressure fed via the terminal 77 into the chamber 63 can flow along the ball of valve 74 and via the direct connection 67 to the front chamber 64 of assembly 59. The piston of this assembly is thus also urged with certainty into its highest position in the above described manner.

The device can be embodied in many different ways. In all cases reliable synchronous operation is obtained, wherein a synchronous adjustment of the pistons occurs at each stroke.

I claim:

1. Hydraulic device comprising at least two cylinder-piston assemblies (8, 10) which are each of the double-action type with a front chamber (18, 19) and a rear chamber (17, 20) on either side of a piston (16, 21) and wherein the chambers of the cylinder-piston assemblies (8, 10) are connected in series in a hydraulic control circuit such that the front chamber (20) of the first assembly (10) has a direct connection (15) to the rear chamber of the second assembly (8), wherein at least one (10) of the cylinder-piston assemblies is provided with valve means comprising a non-return valve and accomodated in a bypass (27) bypassing a piston (21) of said first assembly (10) when the piston of said first assembly is at the top of its stroke and wherein effective piston surfaces are at the same realitive positions in the chambers mutually connected by the direct connection and wherein the piston (21) of said first assembly actuates the valve means thereby opening the bypass (27) when the piston (21) is situated close to the direct connection, charecterized in that the non return valve (26) is arranged such that it permits flow through the bypass (27) towards the direct connection (15) and in that associated with further valve means (30) for opening the bypass (27).

2. Device as claimed in claim 1, characterized in that the cylinder-piston assemblies are identical and have a continuous piston rod.

3. Device as claimed in claim 1 characterized in that the further valve means is formed by the piston (21) in association with openings (30) of the bypass (27) at positions such that these openings lie on opposite sides of the piston (21) when the piston (21) is situated close the direct connection (15).

4. Device as claimed in claim 1 characterized in that the other cylinder-piston assembly (8) connected via the direct connection (15) is also provided with identically functioning valve means (29) which open a bypass (28) bypassing the piston (16) of said other assembly (8) when a piston (16) is situated at the top of its stroke position.

5. Device as claimed in claim 1, characterized in that the bypass (44) extends through the piston (40), the valve means are situated in the piston (40) and actuating means (46) are capable of coming into contact with an end wall (47) of the cylinder in order to open the further valve means.

6. Device as claimed in claim 5, characterized in that the further valve means is a non-return valve accommodated in the bypass (44) permitting flow in the direction from the direct connection (49) and wherein the actuating means (46) can lift the valve member (45) of the non-return valve thereby permitting flow from seat.

7. Device as claimed in claim 1, comprising a number of pairs of cylinder-piston assemblies each connected in series, wherein the hydraulic control circuit comprises valve means for connecting the pairs of assemblies at choice in parallel or in series.

8. The use of the device as claimed in claim 1 in a fork-lift truck (1) comprising a vehicle (2), a mast (3) arranged on the vehicle (2), a fork carrier (4) slidable along the mast and two extending prongs (5) mounted on the fork carrier (4) and each comprising a basic body with a horizontally protruding portion (7) and a sleeve (9) connected by at least one hydraulic cylinder-piston assembly (8, 10) to the basic body and slidable over the protruding portion (7) thereof, wherein these cylinder-piston assemblies (8, 10) are connected in series in the hydraulic control circuit.

9. The use of the device as claimed in claim 7,in a punching table (50) comprising four cylinder-piston assemblies (38, 59) connected in two pairs and arranged on the corners of the table (50).

10. Device as claimed in claim 1, characterized in that the cylinder-piston assemblies include a first assembly having a first cylinder and a first piston and a second assembly having a second cylinder and a second piston, said first and second pistons connected to first and second piston rods respectively, which rods protrude from one side of said pistons and wherein a chamber of said first assembly through which said first piston rod does not extend has a direct connection with a chamber (18) of said second assembly through which said second piston rod does extend and wherein the diameter of said first cylinder of said first assembly, the diameter of said second cylinder and the diameter of said second piston rod are sized such that the diameter of said second cylinder of said second assembly squared subtracted from the diameter of said second piston rod squared equals the diameter of said first cylinder of said first assembly squared.

* * * * *